US007052309B1

(12) United States Patent
Chen

(10) Patent No.: US 7,052,309 B1
(45) Date of Patent: May 30, 2006

(54) ELECTRIC PLUG HAVING PULL RING

(76) Inventor: Tsang-I Chen, Room 707, No. 293, Sung Chiang Rd., Taipei (TW)

( * ) Notice: Subject to any disclaimer, the term of this patent is extended or adjusted under 35 U.S.C. 154(b) by 0 days.

(21) Appl. No.: 11/183,799

(22) Filed: Jul. 19, 2005

(51) Int. Cl.
*H01R 13/00* (2006.01)

(52) U.S. Cl. ..... 439/484; 439/923

(58) Field of Classification Search ..... 439/152, 439/159, 489, 692, 694, 923, 484
See application file for complete search history.

(56) References Cited

U.S. PATENT DOCUMENTS 1,699,722 A * 1/1929 Stott ..... 439/484
2,226,385 A * 12/1940 Ramsey ..... 200/554
2,507,092 A * 5/1950 Cline ..... 439/484
2,722,575 A * 11/1955 Dobkins ..... 200/52 R
5,057,036 A * 10/1991 Dickie ..... 439/484
5,454,731 A * 10/1995 Dickie ..... 439/484
6,053,762 A * 4/2000 Matsumura et al. ..... 439/484
6,736,666 B1 * 5/2004 Yu ..... 439/484

* cited by examiner

*Primary Examiner*—James R. Harvey
(74) *Attorney, Agent, or Firm*—Bacon & Thomas PLLC

(57) ABSTRACT

An electric plug includes two locating blocks aligned at two sides of the housing thereof to pivotally hold a substantially C-shaped pull ring. The pull ring has two pivot holes aligned at the ends thereof and respectively pivotally connected to the locating blocks by a respective pivot bolt that has a head stopped outside the respective pivot hole. The heads of the pivot bolts each have a diameter greater than that of the pivot holes so as to prevent disconnection of the pull ring from the housing.

2 Claims, 5 Drawing Sheets

ELECTRIC PLUG HAVING PULL RING

BACKGROUND OF THE INVENTION

1. Field of the Invention

The present invention relates to electric plugs and more particularly, to an electric plug having a pull ring.

2. Description of the Related Art

FIGS. 4 and 5 show a conventional flat type electric plug 70. For easy removal of the electric plug 70 from the electric socket, a pull ring 72 is pivotally coupled to the housing 71 of the electric plug 70. According to this design, the pull ring 72 is an arched wire rod having two hooked ends respectively hooked in the housing 71. If the pulling force surpasses the binding force between the pull ring 72 and the housing 71 when the user pulls the pull ring 72, the pull ring 72 will be deformed and disconnected from the housing 71. Because this flat type electric plug 70 has a thin thickness, it is difficult to pull the electric plug 70 from the electric socket after disconnection of the pull ring 72 from the housing 71.

SUMMARY OF THE INVENTION

The present invention has been accomplished under the circumstances in view. It is the main object of the present invention to provide an electric plug with a pull ring, which prevents disconnection of the pull ring from the housing of the electric plug when the user pulls the pull ring to disconnect the electric plug from the electric socket, assuring a safety use.

To achieve this object of the present invention, the electric plug provided by the present invention comprises a housing and a substantially C-shaped pull ring pivotally connected to the housing. The housing has two connecting portions opposite to each other. In the hosing at least two conductive members are respectively disposed and an electric wire is electrically connected to the conductive members. The pull ring has two pivot holes at two ends thereof corresponding to the connecting portions of the housing respectively. Two pivots are respectively inserted through the pivot holes of the pull ring and fastened to the connecting portions of the housing to pivotally secure the pull ring to the housing. The pivots each have a head with a diameter greater than that of the pivot holes so as to prevent the disconnection of the pull ring from the housing.

DETAILED DESCRIPTION OF THE INVENTION

Figure 1:
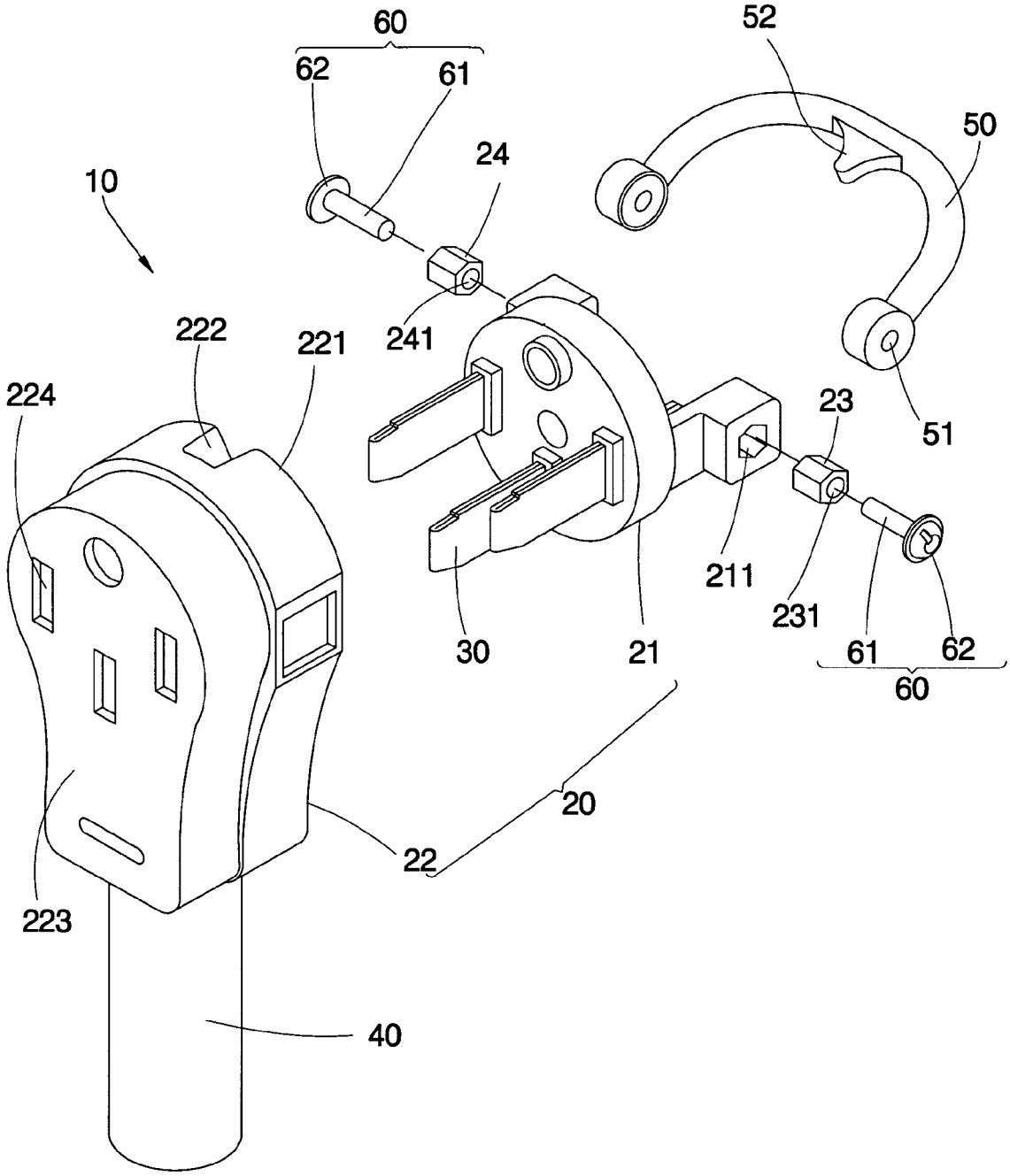
FIG. 1 is an exploded view of an electric plug having a pull ring according to a preferred embodiment of the present invention.
Figure 2:
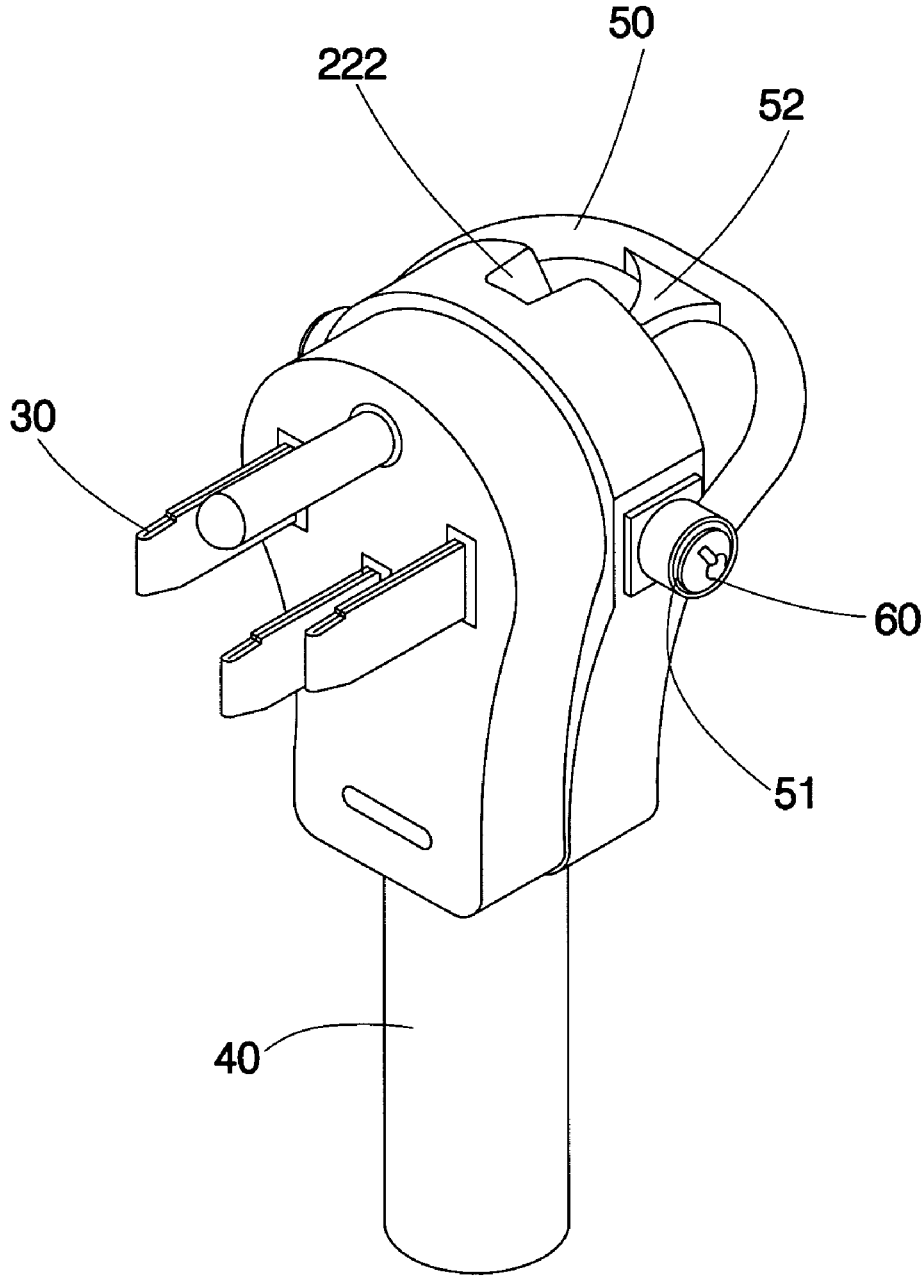
FIG. 2 is a perspective assembly view of the electric plug having a pull ring according to the preferred embodiment of the present invention.
Figure 3:
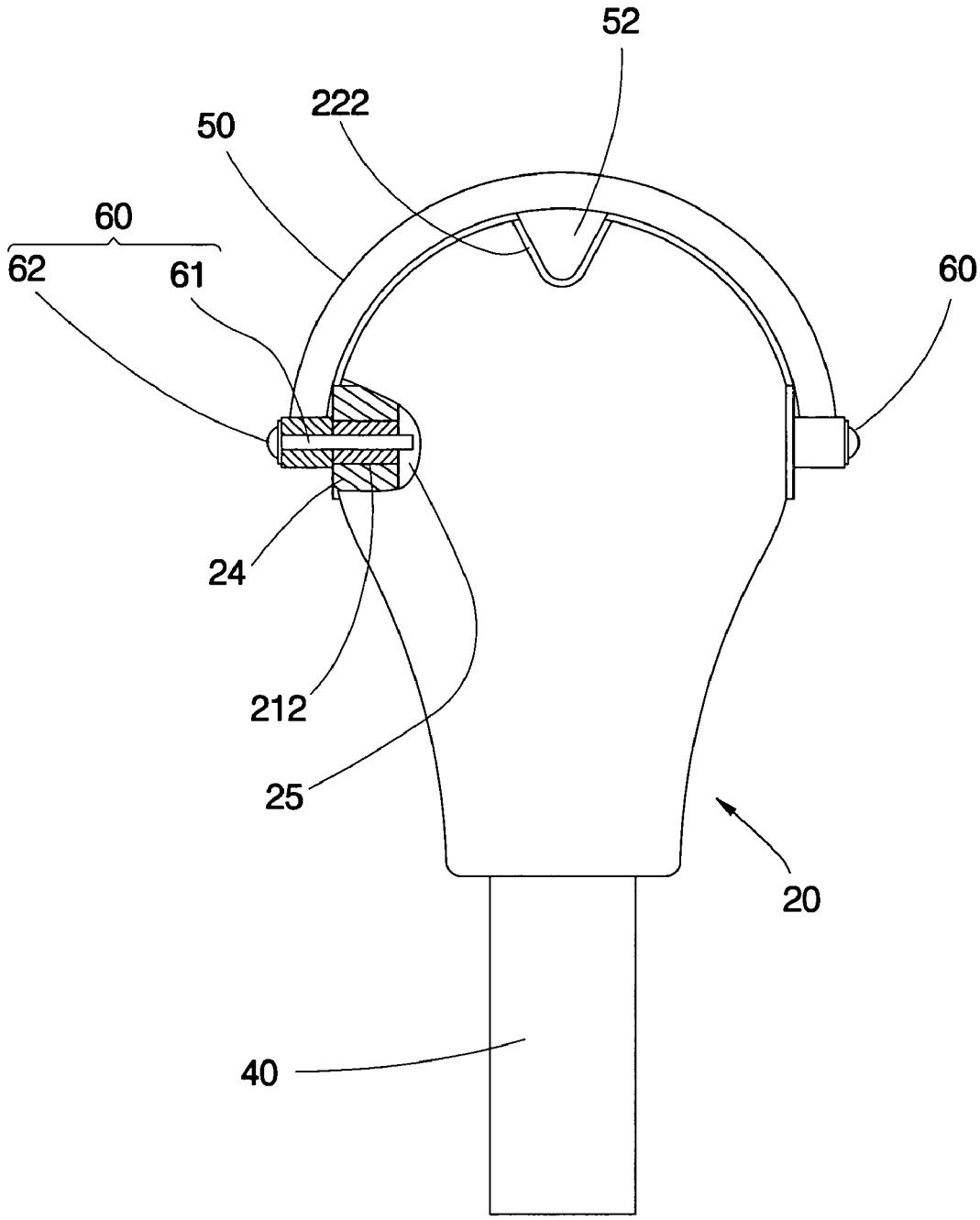
FIG. 3 is a schematic drawing of the present invention, showing the protruding portion of the pull ring engaged into the recessed portion of the housing.
Figure 4:
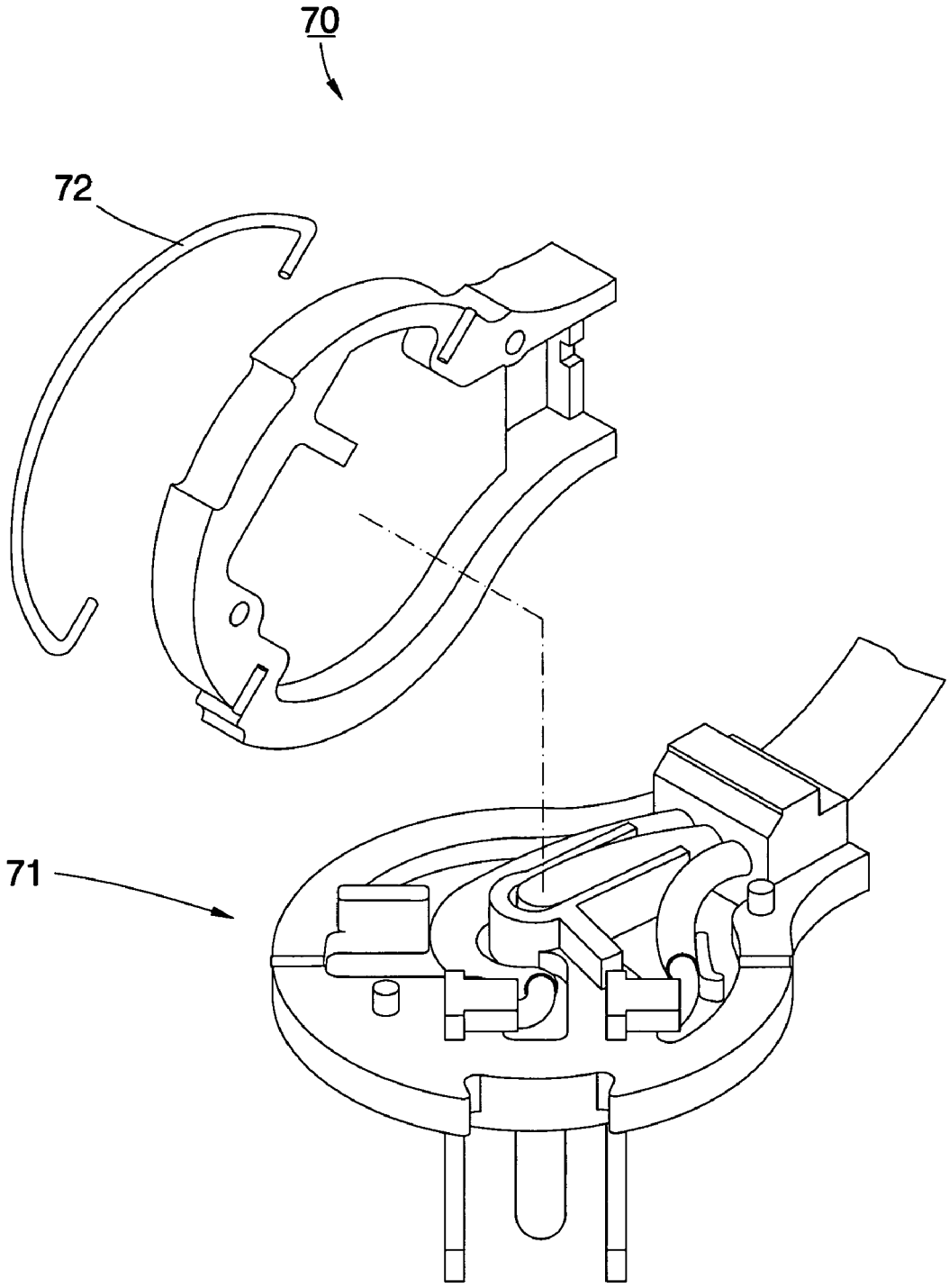
FIG. 4 PRIOR ART
FIG. 4 is an exploded view of a conventional flat type electric plug.
Figure 5:
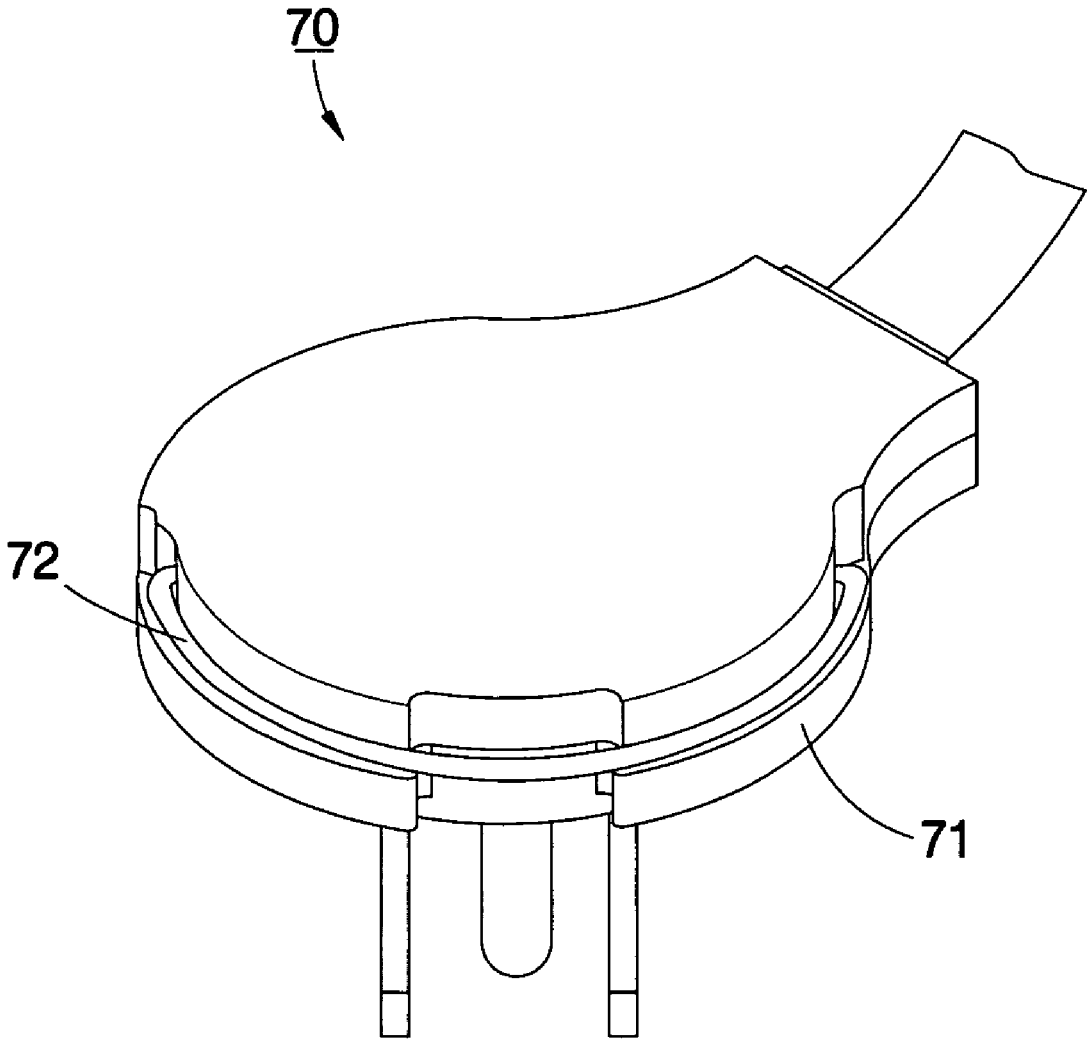
FIG. 5 PRIOR ART
FIG. 5 is a perspective assembly view of the conventional flat type electric plug shown in FIG. 4.

Referring to FIG. 1, an electric plug 10 in accordance with the first embodiment of the present invention is shown comprised of a housing 20, three conductive members 30, an electric wire 40, a pull ring 50, and two pivots 60.

The housing 20 is a hollow member comprised of an upper cover shell 21, a bottom cover shell 22, and two locating blocks 23 and 24. The upper cover shell 21 and the bottom cover shell 22 are fastened together, defining therein an inside chamber 25. The housing 20 comprises two mounting holes 211 and 212 aligned at two opposite lateral sides, a recessed portion 222 formed in the top wall 221, and a plurality of through holes 224 cut through the bottom wall 223. The two locating blocks 23 and 24 are respectively affixed to the mounting holes 211 and 212, forming a respective connecting portion. The locating blocks 23 and 24 each have a screw hole 231 or 241.

The conductive members 30 are metal members affixed to the upper cover shell 21 and respectively inserted through the inside chamber 25 and the through holes 224.

The electric wire 40 is inserted through one end of the housing 20 into the inside chamber 25, having a plurality of conductors (not shown) respectively electrically connected to the conductive members 30.

The pull ring 50 can be made of a C-shaped metal wire rod or elastic plastic rod, having two pivot holes 51 disposed at the two distal ends and axially aligned, and a conical protruding portion 52 on the middle. The conical protruding portion 52 faces the imaginary axis passing through the pivot holes 51. The pull ring 50 bridges the housing 20, keeping the pivot holes 51 respectively aligned with the screw holes 231, 241 of the locating blocks 23 and 24 and the conical protruding portion 52 aimed at the recessed portion 222 of the housing 20.

The pivots 60 are screw bolts, each having a threaded shank 61 and a head 62 at one end of the threaded shank 61. The threaded shanks 61 of the pivots 60 are respectively inserted through the pivot holes 51 of the pull ring 50 and threaded into the screw holes 231 and 241 of the locating blocks 23 and 24. The heads 62 of the pivots 60 have a diameter greater than the pivot holes 51 of the pull ring 50. When installed, the heads 62 of the pivots 60 are respectively stopped outside the pivot holes 51 of the pull ring 50.

When the electric plug is assembled, the heads 62 of the pivots 60 prohibits disconnection of the two ends of the pull ring 50 from the threaded shanks 61 and the locating blocks 23, i.e., pulling the pull ring 50 to remove the electric plug from the electric socket does not cause disconnection of the pull ring 50 from the housing 20. Further, when the pull ring 50 is not used, the pull ring 50 is received to the periphery of the housing 20 to force the conical protruding portion 52 into the recessed portion 222, preventing interference of the pull ring 50 with the conductive members 30.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. An electric plug comprising:

a housing have two connecting portions opposite to each other;

at least two conductive members respectively disposed inside said housing;

an electric wire inserted into said housing and electrically connected to said conductive members; and a substantially C-shaped pull ring having two pivot holes at two ends thereof corresponding to the connecting portions of said housing respectively;

two pivots respectively inserted through the pivot holes of said pull ring and fastened to the connecting portions of said housing to pivotally secure said pull ring to said housing, said pivots each having a head with a diameter greater than that of said pivot holes;

wherein said two connecting portions each have a locating block having a screw hole; said pivots each have a threaded shank respectively extending from the respective head and respectively threaded into the screw hole of the locating block.

2. The electric plug as claimed in claim 1, wherein said pull ring has a protruding portion; said housing has a recessed portion for accommodating the protruding portion of said pull ring.

* * * * *